US005927203A

United States Patent [19]

Gieser et al.

[11] Patent Number: 5,927,203

[45] Date of Patent: Jul. 27, 1999

[54] DEVICE AND METHOD FOR GUIDING SHEET MATERIAL IN A PRINTING PRESS, PARTICULARLY IN A SHEET-FED ROTARY OFFSET PRESS

[75] Inventors: Michael Gieser, Oftersheim; Stephan Günter, Wiesloch-Baiertal, both of Germany

[73] Assignee: Heidelberger Druckmaschinen AG, Heidelberg, Germany

[21] Appl. No.: 09/079,585

[22] Filed: May 15, 1998

Related U.S. Application Data

[62] Division of application No. 08/808,783, Feb. 28, 1997, Pat. No. 5,797,327.

[30] Foreign Application Priority Data

Feb. 28, 1996 [DE] Germany ..... 196 07 397

[51] Int. Cl.[6] ..... B41F 5/02; B65H 29/64

[52] U.S. Cl. ..... 101/419; 271/195

[58] Field of Search ..... 101/419, 424.1, 101/230, 231, 232; 271/195

[56] References Cited

U.S. PATENT DOCUMENTS

| | | | |
|---|---|---|---|
| 3,385,490 | 5/1968 | Malmgren et al. . | |
| 3,622,058 | 11/1971 | Vits | 101/228 |
| 3,624,807 | 11/1971 | Schwebel . | |
| 4,372,550 | 2/1983 | Woods . | |
| 4,572,071 | 2/1986 | Cappel et al. . | |
| 4,913,049 | 4/1990 | Sainio | 101/225 |
| 5,395,029 | 3/1995 | Kurie . | |
| 5,411,251 | 5/1995 | Schmid et al. . | |
| 5,553,542 | 9/1996 | Jackson et al. | 101/228 |
| 5,609,103 | 3/1997 | Stephan et al. | 101/230 |
| 5,634,636 | 6/1997 | Jackson et al. . | |
| 5,655,449 | 8/1997 | Henn et al. . | |
| 5,687,964 | 11/1997 | Stephan et al. | 271/195 |

FOREIGN PATENT DOCUMENTS

| | | |
|---|---|---|
| 0 346 080 A1 | 12/1989 | European Pat. Off. . |
| 44 06 844 A1 | 9/1995 | Germany . |

*Primary Examiner*—Eugene Eickholt
*Attorney, Agent, or Firm*—Herbert L. Lerner; Laurence A. Greenberg

[57] ABSTRACT

A device for guiding sheet material in a printing press, the device having a guide surface located below a path in which a sheet is guidable, includes nozzles arranged in zones within the guide surface, the zones including a first zone extending along a longitudinal axis of the guide surface, and a second and a third zone, respectively, located at left-hand and right-hand sides of the first zone, the nozzles in the first zone being blast nozzles having a blowing direction with a component extending orthogonally relative to the guide surface, the nozzles in the second and third zones being blast nozzles having a blowing direction extending essentially from the longitudinal axis of the guide surface to lateral edges of the guide surface, the nozzles of the first zone being suppliable with blast air independently of a supply of air to the nozzles of the second and the third zones; and a method of operating the guiding device.

20 Claims, 4 Drawing Sheets

DEVICE AND METHOD FOR GUIDING SHEET MATERIAL IN A PRINTING PRESS, PARTICULARLY IN A SHEET-FED ROTARY OFFSET PRESS

CROSS-REFERENCE TO RELATED APPLICATIONS

This application is a division of application Ser. No. 08/808,783, filed on Feb. 28, 1997, now U.S. Pat. No. 5,797,327, which is hereby incorporated by reference.

BACKGROUND OF THE INVENTION

Field of the Invention

The invention relates to a device and method for guiding sheet material in a printing press, particularly in a sheet-fed rotary offset printing press, the device having a guide surface located below a path in which a sheet is guidable, and nozzles arranged in zones within the guide surface, the zones including a first zone extending along a longitudinal axis of the guide surface, and a second and a third zone, respectively, located at the left-hand and right-hand sides of the first zone.

When transporting sheet material through a printing press, in particular, a sheet-fed offset rotary printing press, it is generally necessary to guide the sheet material over given stretches or distances without fluttering and as taut as possible without any breaks or distortions in the taut or stretched disposition thereof. For this purpose, guide surfaces are used having air nozzles arrayed therein through which air is blown against the underside of the sheet, so that the sheet is guided in a floating manner above the guide surface.

The German Published Non-prosecuted Patent Application (DE-OS) 44 06 844 discloses a device for floatingly guiding sheets in a rotary printing press, the device having a guide surface provided with air nozzles arranged in three zones extending in a direction of travel of a sheet and across the entire width of the sheet guide surface, the nozzles being always supplied with air both in one-sided or recto sheet printing as well as in recto/verso or first form and perfector sheet printing modes, thereby assuring reliable flotation of the sheet in either printing or operating mode. To keep the sheet taut simultaneously with the flotation thereof, the nozzles in the center region along the longitudinal axis of the sheet guide surface blow air in a direction substantially opposite to the motion of the sheet and towards the trailing edge of the sheet. This is intended to tauten or apply tension to the sheet in the longitudinal direction of the sheet. The nozzles arranged in the other two lateral zones blow air in a direction substantially towards the side and the trailing edge of the sheet, so that, in these lateral guide zones, the sheet is tautened or subjected to tension both laterally and in the longitudinal direction thereof. This published German patent application does not offer any indication that the nozzles in the center zone blow air in the direction of motion of the sheet, nor that air be applied to or blown through the nozzles in the center zone in the recto/verso printing or operating mode and that the nozzles be shut off in the recto or one-sided sheet printing mode.

SUMMARY OF THE INVENTION

It is accordingly an object of the invention of the instant application to provide a device and a method for reliably guiding sheets printed on both sides thereof during the recto/verso printing mode, and by which extremely brief set-up times and reliable and effective tensioning or tautening of the sheet can be realized at high printing speeds in recto or first form printing mode. It is a further object of the invention to provide such a device and method by which the power consumption and complexity of the sheet guiding device in the recto or first form printing mode are reduced.

With the foregoing and other objects in view, there is provided, in accordance with one aspect of the invention, a device for guiding sheet material in a printing press, the device having a guide surface located below a path in which a sheet is guidable, and comprising nozzles arranged in zones within the guide surface, the zones including a first zone extending along a longitudinal axis of the guide surface, and a second and a third zone, respectively, located at left-hand and right-hand sides of the first zone, the nozzles in the first zone being blast nozzles having a blowing direction extending generally in a sheet transport direction, the nozzles in the second and third zones being blast nozzles having a blowing direction extending generally from the longitudinal axis of the guide surface to lateral edges of the guide surface, the nozzles of the first zone being suppliable with blast air independently of a supply of air to the nozzles of the second and the third zones.

In accordance with another feature of the invention, the guiding device includes a blast box assigned to the first zone and communicating with the nozzles of the first zone for supplying blast air thereto.

In accordance with a further feature of the invention, the guiding device includes a first blower assigned to the blast box for the first zone for supplying blast air to the blast box for the first zone.

In accordance with an added feature of the invention, the printing press is convertible to recto printing mode, the first blower being switchable off when the printing press is in the recto printing mode.

In accordance with an additional feature of the invention, the guiding device includes respective blast boxes assigned to the second and the third zones for supplying blast air to the nozzles of the second and the third zones.

In accordance with yet another feature of the invention, the guiding device includes at least one blower for supplying blast air to the blast boxes assigned to the second and the third zones.

In accordance with an alternative feature of the invention, the one blower is common to both of the blast boxes assigned to the second and the third zones.

In accordance with another alternative feature of the invention, respective separate blowers are provided for supplying blast air to the blast boxes assigned to the second and the third zones.

In accordance with yet a further feature of the invention, the printing press is convertible between recto and recto/verso printing modes, and the nozzles of the second and the third zones are suppliable with blast air by the at least one blower in both the recto and the recto/verso printing modes.

In accordance with yet an added feature of the invention, the nozzles of the first zone are suppliable with blast air by the at least one blower in the recto/verso printing mode, and the nozzles of the first zone are not suppliable with blast air by the at least one blower in the recto printing mode.

In accordance with yet an additional feature of the invention, blast air is blowable by the nozzles of the second and the third zones in a direction which is from 30° to at least 120° offset from the sheet transport direction.

In accordance with another feature of the invention, the nozzles of the zones are formed as slit nozzles disposed in the guide surface.

In accordance with another aspect of the invention, there is provided a method for guiding sheets in a sheet-fed offset rotary printing press which can be operated in both recto and recto/verso printing modes, and in which sheets are transported at least in sections across a guide surface having nozzles arranged in zones within the guide surface, the zones including a first zone extending along a longitudinal axis of the guide surface and having nozzles which blow air generally in a transport direction of the sheets and, on respective sides of the first zone, a second and a third zone wherein air is blown in a direction generally away from the longitudinal axis of the guide surface, which comprises supplying blast air to the nozzles of the second and the third zones in both the recto and the recto/verso printing modes, and supplying blast air to the nozzles of the first zone in the recto/verso printing mode and interrupting the supply of blast air to the nozzles of the first zone during the recto printing mode.

A particular advantage of the invention is that no complex set-up work is required to convert the sheet guiding device between recto or first form and recto/verso or first-form and perfector printing modes. A further advantage of the device according to the invention is that it can readily be installed in the vicinity of drying zones wherein high temperatures prevail and wherein the installation of reversible axial fans or axial blowers is not possible.

Other features which are considered as characteristic for the invention are set forth in the appended claims.

Although the invention is illustrated and described herein as embodied in a device and method for guiding sheet material in a printing press, in particular, in a sheet-fed offset rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
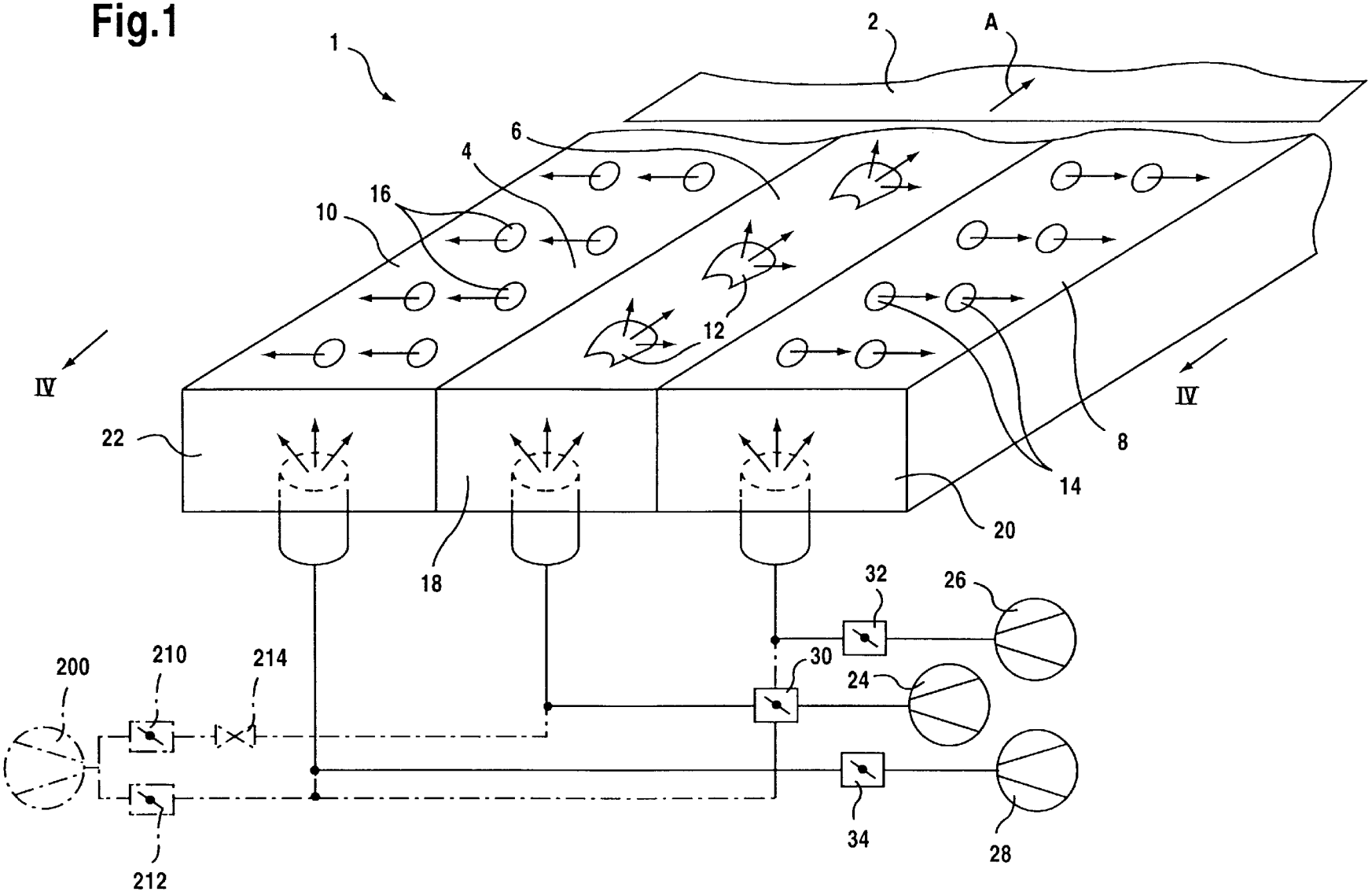
FIG. 1 is a fragmentary diagrammatic and schematic three-dimensional cross-sectional view of a device for guiding sheet material in accordance with the invention, the device having three separate zones through which air is blowable.
Figure 2:
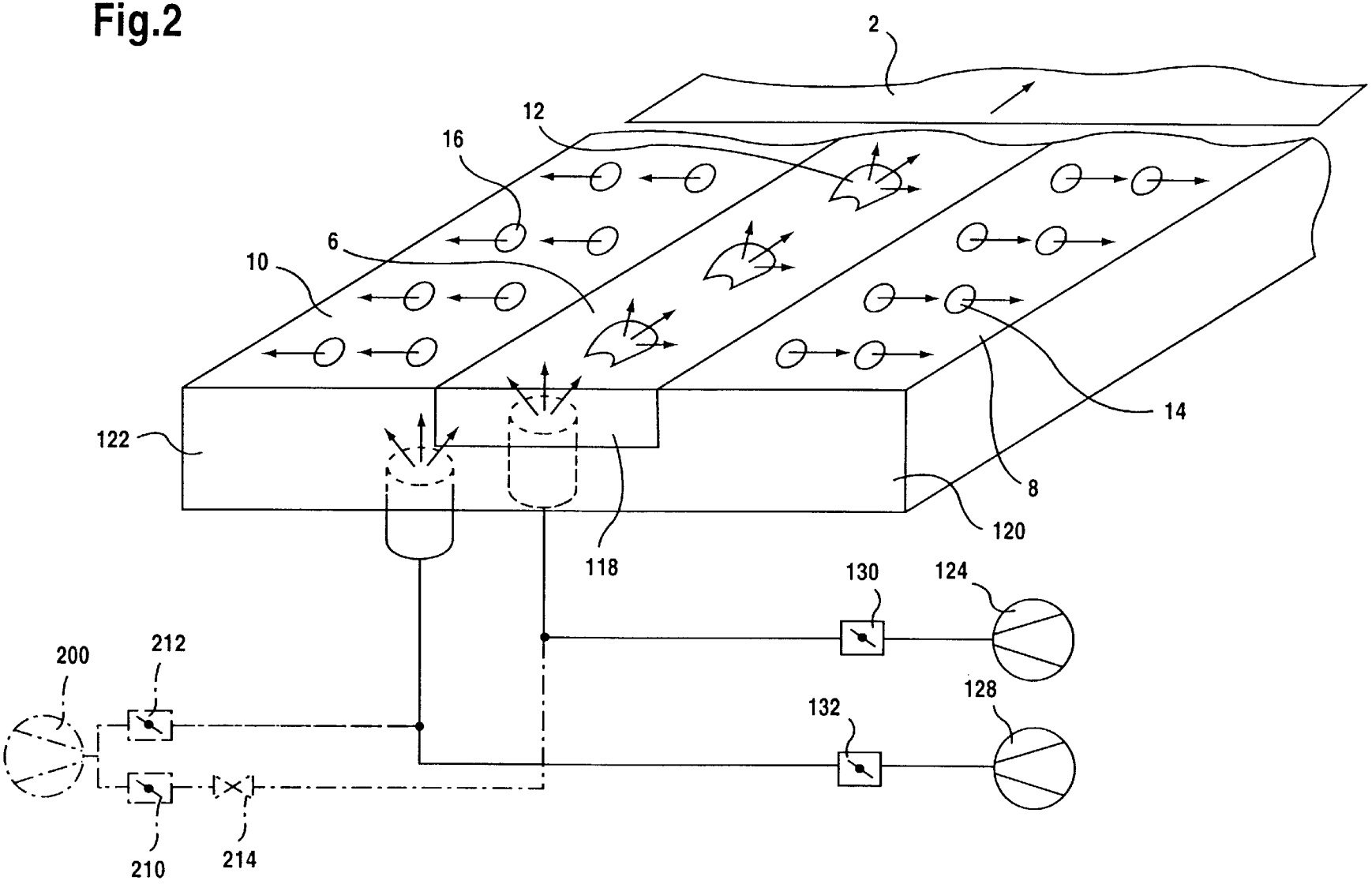
FIG. 2 is a view similar to that of FIG. 1 of a different embodiment of the device according to the invention, wherein the lateral zones are mutually flow-connected and the center zone as well as the two outer zones are subjectible to blast air from blowers.

Referring now to the drawings and, first, particularly to FIG. 1 thereof, there is shown therein a device 1 for guiding sheet material 2 in a printing press, e.g., a sheet-fed rotary offset printing press, having a guide surface 4 over which a sheet 2 is moved in a direction indicated by an arrow A. In a preferred embodiment of the invention, such as is shown in FIGS. 1 and 2, the guide surface is made up of a total of three zones 6, 8 and 10 extending over the length of the guide surface 4, the zone 6 thereof being in the center of the guide surface 4, and zones 8 and 10 being located at lateral edges of the guide surface 4. Air nozzles 12, 14, and 16, which are shown only diagrammatically in the figures, are arranged in zones 6, 8 and 10, respectively, appertaining arrows indicating the direction in which air is blown through the nozzles 12, 14 and 16. With regard to the preferred embodiment of the invention shown in FIGS. 1 and 2, the direction in which air is blown through the nozzles 12 in the center or first zone 6 is essentially or generally the direction of travel of the sheet 2 represented by the arrow A, but may also include a respective component in a direction towards the sides of the sheet guide surface 4. Air is blown through the nozzles 14 in the right-hand side or second zone 8 of FIGS. 1 and 2 on the right-hand side of the guide surface 4 in substantially a direction towards the right-hand lateral edge of the guide surface 4; air is blown through the nozzles 16 in the left-hand side or third zone 10 in substantially a direction towards the left-hand lateral edge of the guide surface 4. The direction in which air is blown through the nozzles 14 and 16 is preferably offset 90° from the direction of travel represented by the arrow A, but may lie within a range of from 30° to 120°.

Figure 3:
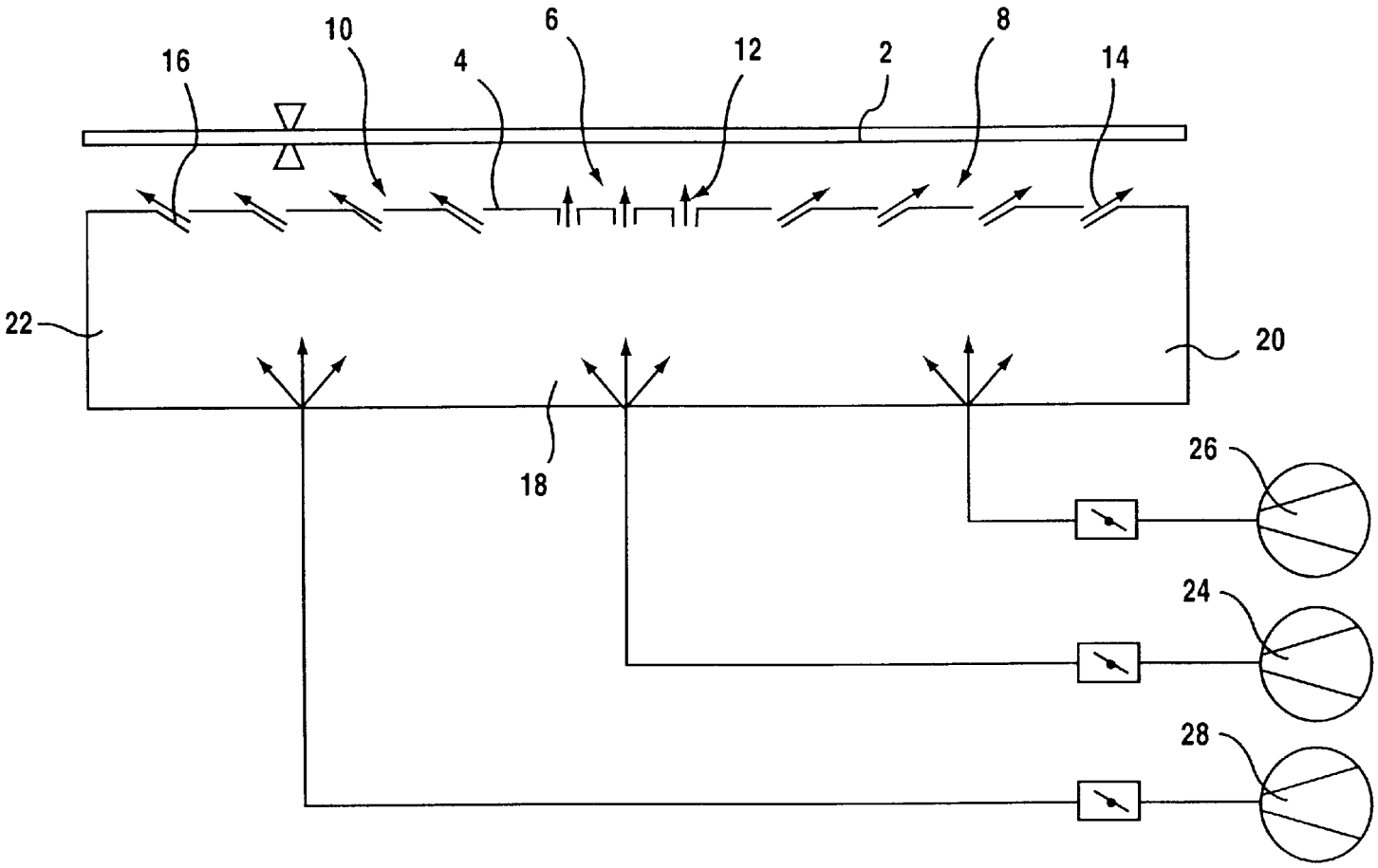
FIG. 3 is a diagrammatic and schematic cross-sectional view of the device according to the invention during a recto/verso or first form and perfector printing mode.
Figure 4:
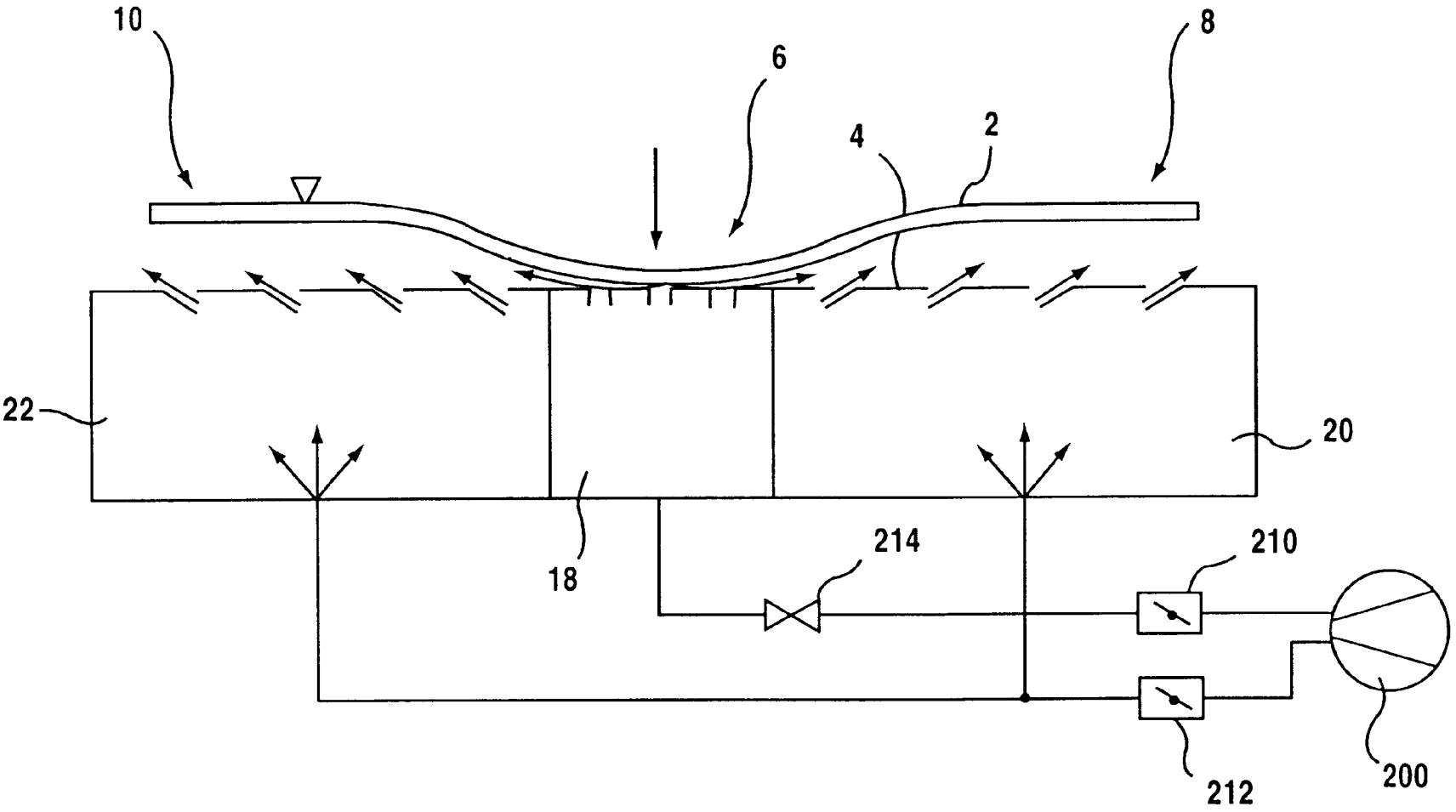
FIG. 4 is a cross-sectional view of FIG. 1 in recto or first form printing mode, taken along the line IV—IV in the direction of the arrows.

The nozzles 12, 14 and 16 can, in theory, be any type of nozzle and, in the preferred embodiment of the invention, are slit nozzles of the prior art, preferably having diverging air streams and being stamped into a guide surface 4 formed of a single, planar metal sheet. The direction in which the air is blown through at least the lateral nozzles 14 and 16, is, as shown in FIGS. 3 and 4, essentially tangential to the guide surface 4 but can also include a component in the direction of the surface normals of the guide surface 4. FIG. 3 illustrates, by way of example, the direction in which air is blown through the lateral nozzles 14 and 16. The direction in which air is blown through the nozzles 12 arranged in the center zone 6 is likewise preferably tangential to the guide surface 4 but may likewise include a vertical component relative to the guide surface 4. To produce an improved flotation condition around the nozzles 12 of the central zone 6, non-illustrated nozzles formed by a round opening in the center zone 6 may be provided for blowing air having only a component in the direction of the surface normals of the guide surface 4. In the preferred embodiment of the invention, the nozzles 14 and 16 are distributed across the lateral bordering zones 8 and 10 so that blast-air streams or jets from the nozzles close to the center zone 6 pass between the outer nozzles and are not aimed directly at the center of the outer nozzles. The formation of an even, homogenous flow from the lateral nozzles 14 and 16 is thereby able to be achieved, which ensures lateral tensioning of the sheet during transport thereof over the guide surface 4, both in recto or first form printing as well as in recto/verso or first-form and perfecter printing modes. The packing density of the nozzles in the zones 6, 8 and 10 can be homogenous and uniform within a zone, but may also be inhomogeneous, for example, increasingly less dense from the center of the guide surface 4 to the lateral edges.

As is shown in FIG. 1, separate blast boxes 18, 20 and 22 are located beneath each of the zones 6, 8 and 10, respectively, and are flowwise connected to appertaining blowers 24, 26 and 28, respectively, for supplying blast air to the printing press during the recto/verso mode of sheet printing. In this embodiment of the invention, each blast box 18, 20, 22 is supplied with air from a separate blower 24, 26, 28. The volume of air is preferably set by adjusting the speed of the blowers 24, 26 and 28 accordingly, avoiding the need for costly and complex throttle valves.

In another embodiment of the invention, as shown in FIG. 1, the blowers 24, 26 and 28 can also be connected with the ducts 18, 20 and 22 via throttle valves 30, 32 and 34. The air volume is then set by adjusting the throttle position of the valves 30, 32 and 34.

As shown in FIG. 3, the blast air produces, during the recto/verso sheet printing mode, a constant cushion of air beneath the sheet 2, whereon the sheet 2 is transported across the guide surface 4 reliably and at a constant spaced distance above the guide surface 4, the underside of the sheet which, in this case, is printed being out of contact with the guide surface 4. The floating condition between the sheet 2 and the guide surface 4 in the zones 6, 8 and 10 can be controlled by suitably adjusting the blower speed and valve lift, respectively, due to which, depending upon the production printing speed of the printing press in recto/verso operating mode, a reliable and troublefree guidance of the sheet is able to be achieved.

In a further embodiment of the invention, which is shown, for example, in FIG. 2, the outer, lateral blast boxes 120 and 122 are connected flowwise to one another and are supplied with blast air from a common blower 128 and an appertaining flow restrictor or throttle 132. In this case, the device requires only two blowers 124 and 128. Furthermore, the blast boxes 18, 118, 20, 120 and 22, 122 of the embodiments of the invention shown in FIGS. 1 and 2 can be supplied with air by a single blower 200 represented in phantom in FIG. 2 and corresponding flow restrictors or throttles 210 and 212. In this embodiment of the invention, a check valve 214 is located in the air supply line to the center blast box 18, 118, by which the supply of air to the center blast box 18, 118 can be interrupted so that no air is supplied to the center blast box 18, 118 while the lateral blast boxes 20, 120 continue to be supplied with air from the blower 200. Of course, the checking or blocking effect can also be achieved by combining the valves 210 and 214 into a single unit.

By interrupting the supply of blast air to the nozzles 12 of the center blast box 18, 118 of the center zone 6 of the guide surface 4, either by shutting off the blower 24, 124, or, in the case of an embodiment of the invention having only a single blower 200, by closing or blocking the check valve 214, the sheet 2 is lowered in the center zone 6 towards the guide surface 4 so that the underside of the sheet 2 touches the surface of the guide surface 4. The lowering of the sheet 2 in the center zone 6 is based upon the so-called ejector effect in which the outward flow of air from the lateral nozzles 14 and 16 entrains the air in the center zone 6 and transports it outwardly, evacuating this zone and producing an underpressure if little or no air flows through the nozzles 12 when the blower 24, 124 is shut off or the check valve 214 is closed. The bottom of the sheet 2 is sucked against and glides along the guide surface 4 in the center zone 6, due to which, in recto or first-form printing mode in particular, a tensioning or tautening of the sheet 2 along the length thereof occurs, which, together with the lateral tensioning or tautening of the sheet 2 caused in the recto or first-form printing mode by the outward flow of air in the lateral zones 8 and 10, ensures a troublefree sheet travel or guidance.

By turning on or turning off the flow of blast air in the center zone 6, the press can easily be converted from a recto/verso printing mode, wherein the flow of blast air is turned on and, as shown in FIG. 3, the sheet is neatly suspended or floats on a cushion of air, to a recto or first-form printing mode, wherein the unprinted underside of the sheet 2 glides along the guide surface 4 in the center zone 6. Once the flow of blast air for proper sheet transport in the recto/verso operating mode has been set, the press can be quickly switched between recto or first-form printing mode and recto/verso or first-form and perfecter printing mode by turning on and turning off the flow of blast air in the zone 6 without having to make any additional adjustments of the air volumes or air flow guide paths. A further advantage is that no exhaust fan or suction blower is needed to suck the sheet downwardly in the zone 6 during the recto or first-form printing mode. This significantly reduces both the complexity of the device 1 of the invention, as well as the power requirements therefor in the recto or first-form printing mode.

We claim:

1. A device for guiding sheet material in a printing press, comprising:

a guide surface located below a path in which a sheet is guidable;

nozzles arranged in zones within said guide surface, said zones include a first zone extending along a longitudinal axis of said guide surface, and a second and a third zone, respectively, located at left-hand and right-hand sides of said first zone, the nozzles in said first zone are blast nozzles having a blowing direction orthogonal relative to said guide surface, the nozzles in said second and third zone are blast nozzles having a blowing direction extending essentially from the longitudinal axis of said guide surface to lateral edges of said guide surface, said nozzles in said first zone suppliable with blast air independently of a supply of air to said nozzles of said second and said third zone.

2. The device according to claim 1, wherein said nozzles in said second and said third zone have a blowing direction extending 90° offset from a sheet transport direction.

3. The device according to claim 2, wherein said nozzles in said second and third zones are formed as slit nozzles disposed in said guide surface.

4. The device according to claim 1, wherein said nozzles in said second and third zone have a blowing direction with a component extending orthogonally relative to said guide surface.

5. The device according to claim 1, wherein said nozzles in each of said second and said third zone comprise a first and a second group of nozzles, said nozzles of said first group provided further away from a respective left hand and right hand lateral edge of said guide surface than said nozzles of said second group, said nozzles of the first group have a blowing direction such that the blast air from said nozzles of said first group passes between said nozzles of said second group.

6. The device according to claim 1, wherein said nozzles in said second and said third zone have a decreasing density in direction toward a respective left hand and right hand lateral edge of said guide surface.

7. The device according to claim 1, wherein said nozzles in said first zone have a blowing direction with a component extending in a sheet transport direction.

8. The device according to claim 1, wherein said nozzles in said first zone have a blowing direction with a component extending from the longitudinal axis of said guide surface to said lateral edges of said guide surface.

9. The device according to claim 1, wherein said nozzles in said first zone have a decreasing density in direction toward said lateral edges of said guide surface.

10. The device according to claim 1, further comprising additional nozzles in said first zone which have a blowing direction extending only orthogonally relative to said guide surface.

11. The device according to claim 1, including a blast box assigned to said first zone and communicating with said nozzles of said first zone for supplying blast air thereto.

12. The device according to claim 11, including a blower assigned to said blast box for said first zone for supplying blast air to said blast box for said first zone.

13. The device according to claim 12, including a valve disposed between said blower and said blast box, the printing press has a recto printing mode, and said blast air supplied to said blast box to be switch off via said valve when the printing press is in said recto printing mode.

14. The device according to claim 1, including respective blast boxes assigned to said second and said third zone for supplying blast air to said nozzles of said second and said third zone.

15. The device according to claim 14, including at least one blower for supplying blast air to said blast boxes assigned to said second and said third zone.

16. The device according to claim 14, wherein said at least one blower is a single blower common to both of said blast boxes assigned to said second and said third zone.

17. The device according to claim 15, wherein respective separate blowers are provided for supplying blast air to said blast boxes assigned to said second and said third zone.

18. The device according to claim 15, wherein the printing press operates in recto and recto/verso printing modes, and wherein said nozzles of said second and said third zone are suppliable with blast air by said at least one blower in both said recto and said recto/verso printing modes.

19. A method for guiding sheets in a sheet-fed offset rotary printing press which can be operated in both recto and recto/verso printing modes, and in which sheets are transported at least in sections across a guide surface having nozzles arranged in zones within the guide surface, the zones include a first zone extending along a longitudinal axis of the guide surface and having nozzles which blow air in a direction having a component extending orthogonally relative to the guide surface and, on respective sides of the first zone, a second and a third zone wherein air is blown in a direction generally away from the longitudinal axis of the guide surface, which comprises supplying blast air to the nozzles of the second and the third zone in both the recto and the recto/verso printing mode, and supplying blast air to the nozzles of the first zone in the recto/verso printing mode and interrupting the supply of blast air to the nozzles of the first zone during the recto printing mode.

20. A device for guiding sheet material in a printing press, comprising:

a guide surface located below a path in which a sheet is guidable;

nozzles arranged in zones within said guide surface, said zones include a first zone extending along a longitudinal axis of said guide surface, and a second and a third zone, respectively, located at left-hand and right-hand sides of said first zone, the nozzles in said first zone having a blowing direction orthogonal relative to said guide surface, the nozzles in said second and third zone are blast nozzles having a blowing direction extending 90° offset from a sheet travel direction, said nozzles in said first zone suppliable with blast air independently of a supply of air to said nozzles of said second and said third zone.

* * * * *